US006241472B1

(12) United States Patent
Bosch et al.

(10) Patent No.: US 6,241,472 B1
(45) Date of Patent: Jun. 5, 2001

(54) HIGH SHEAR ROTORS AND STATORS FOR MIXERS AND EMULSIFIERS

(75) Inventors: Edward T. Bosch, Hicksville; Kenneth D. Langhorn, Holtsville; Douglas M. Cohen, Commack, all of NY (US)

(73) Assignee: Charles Ross & Son Company, Hauppauge, NY (US)

( * ) Notice: Subject to any disclaimer, the term of this patent is extended or adjusted under 35 U.S.C. 154(b) by 0 days.

(21) Appl. No.: 09/273,908

(22) Filed: Mar. 22, 1999

(51) Int. Cl.[7] ..... F01D 1/02; B01F 7/00

(52) U.S. Cl. ..... 415/208.3; 366/305

(58) Field of Search ..... 415/83, 84, 86, 415/87, 198.1, 199.1, 199.2, 208.2, 208.3; 366/303, 304, 305, 306

(56) References Cited

U.S. PATENT DOCUMENTS 2,738,930 * 3/1956 Schneider ..... 366/279 X
3,627,280 * 12/1971 Fridman et al. ..... 366/303
3,861,655 * 1/1975 Wright ..... 366/305
4,128,342 * 12/1978 Renk ..... 366/305 X
4,201,487 * 5/1980 Backhaus ..... 366/304
4,687,339 * 8/1987 Seeger ..... 366/305
5,295,784 * 3/1994 Grotz ..... 415/55.6

* cited by examiner

*Primary Examiner*—John E. Ryznic
(74) *Attorney, Agent, or Firm*—Galgano & Burke

(57) ABSTRACT

A rotor-stator assembly includes a rotor and a stator, each of which includes at least one surface having a plurality of grooves defining a plurality of ridges and valleys. The grooves are located so that material in the rotor grooves is caused to collide with material in the stator grooves or vice versa. Ideally, the grooves have a curved cross section so that material is caused to spin in the grooves. Material spinning in a stator groove is caused to collide with material spinning in a rotor groove and vice versa. The number of times that particles are caused to collide depends on the number and length of the grooves in relation to the depth of the grooves. Shear zones are located between the grooves on the stator and the grooves on the rotor.

47 Claims, 10 Drawing Sheets

HIGH SHEAR ROTORS AND STATORS FOR MIXERS AND EMULSIFIERS

BACKGROUND OF THE INVENTION

1.Field of the Invention

The invention relates to mixers and emulsifiers used in industrial applications. More particularly, the invention relates to rotors and stators which are used in industrial mixers and emulsifiers.

2.State of the Art

Industrial mixers and emulsifiers are used to blend various materials such as adhesives, coatings, cosmetics, foods, pharmaceuticals, plastics, etc. Depending on the processing requirements, mixers/emulsifiers may be arranged as a "batch" mixer or an "in-line" mixer. In either case, high speed mechanical and hydraulic shearing forces are created by rotating a rotor relative to a stator such that material is drawn axially into the rotor-stator assembly and dispersed radially outward from the rotor-stator assembly. Prior art FIG. 1 shows a schematic representation of a typical rotor-stator assembly 10. The rotor 12 is a stainless steel disk 14 with a number of teeth or vanes 16 and the stator 18 is a stainless steel cylinder having radial openings 20. The rotor 12 is mounted coaxially within the stator 18 and is rotated at a typical speed of 3600 rpm. A close clearance between the rotor and the stator generates a shearing action. Many different rotor and stator designs are in use today. Prior art FIG. 2 shows another type of rotor-stator assembly 22 shown in schematic form. Here the rotor 24 and the stator 26 are substantially similar stainless steel cylinders each having a plurality of teeth or blades 28, 30 which define a plurality of radial openings 32, 34 in the cylinder. The rotor 24 has a slightly smaller diameter than the stator 26 and generates a shearing action between the openings 32, 34 as it rotates relative to the stator 26. Prior art FIG. 3 shows a "multi-rowed" rotor-stator assembly 36. The multi-rowed rotor 38 and the multi-rowed stator 40 are similar cylindrical members each having arrays of teeth 42, 44 arranged in concentric circles. The rotor 38 and the stator 40 are dimensioned so that the rotor 38 fits inside the stator 40 with the rotor teeth 42 and the stator teeth 44 interleaved. Rotor-stator assemblies are available in a variety of sizes, ranging in diameter from two to thirteen inches. The teeth or vanes on a rotor-stator typically have a height which is approximately one tenth to one fifth the diameter of the rotor-stator.

Co-owned U.S. Pat. No. 5,632,596 discloses a rotor-stator assembly having vanes with slots as shown in prior art FIGS. 4–8. The stator 100 is a stainless steel disk having a central fluid opening 102 and a pair of diametrically opposed mounting holes 104, 106. One surface of the stator 100 is provided with seven concentric vanes 108, 110, 112, 114, 116, 118, 120 which define six concentric wells 109, 111, 113, 115, 117, 119. Forty-four radial slots, e.g. 122, are arranged at intervals of 8°, thereby defining forty-four teeth, e.g. 124, in each vane. The rotor 150 is a stainless steel disk having a central keyed mounting hole 152. One surface of the rotor 150 is provided with seven concentric vanes 158, 160, 162, 164, 166, 168, 170 which define six concentric wells 159, 161, 163, 165, 167, 169. Forty-four radial slots, e.g. 172, are arranged at intervals of 8°, thereby defining forty-four teeth, e.g. 174, in each vane. The rotor 150 is dimensioned to match the stator 100. The vanes in the rotor are placed so that they fit into the wells in the stator. The overall heights of the rotor 150 and the stator 100 are dimensioned to provide proper clearance between the rotor and the stator as shown in FIG. 8.

The rotor-stator of the '596 patent achieved a higher amount of shear than the prior art rotor-stators which preceded it. However, there is a limit to the amount of shear which can be achieved with this design. In particular, it has been discovered that the slots in the vanes can allow some material to pass through without being sheared very much.

SUMMARY OF THE INVENTION

It is therefore an object of the invention to provide rotor-stator assemblies which can develop a very high amount of shear.

It is also an object of the invention to provide rotor-stator assemblies which can handle a large throughput with consistent shearing.

It is another object of the invention to provide rotor-stator assemblies which do not permit any material to pass through without being sheared very much.

It is still another object of the invention to provide rotor-stator assemblies which can process materials which could not be processed by prior-art rotor-stator assemblies.

It is a further object of the invention to provide rotor-stator assemblies which can be used in liquid/liquid emulsions, liquid/solid particle dispersions, liquid/solid particle deaglomeration, liquid/solid particle size reduction, liquid/gas dispersion, and solid/gas particle size reduction.

In accord with these objects which will be discussed in detail below, the rotor-stator assembly of the present invention includes a rotor and a stator, each of which includes at least one surface having a plurality of grooves defining a plurality of ridges and valleys. The grooves are located so that material in the rotor grooves is caused to collide with material in the stator grooves or vice versa. Ideally, the grooves have a curved cross section so that material is caused to spin in the grooves. Material spinning in a stator groove is caused to collide with material spinning in a rotor groove and vice versa. The number of times that particles are caused to collide depends on the number and length of the grooves in relation to the depth of the grooves. Shear zones are located between the grooves on the stator and the grooves on the rotor. When the rotor spins, all the material is forced through the entire shear zone or zones.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
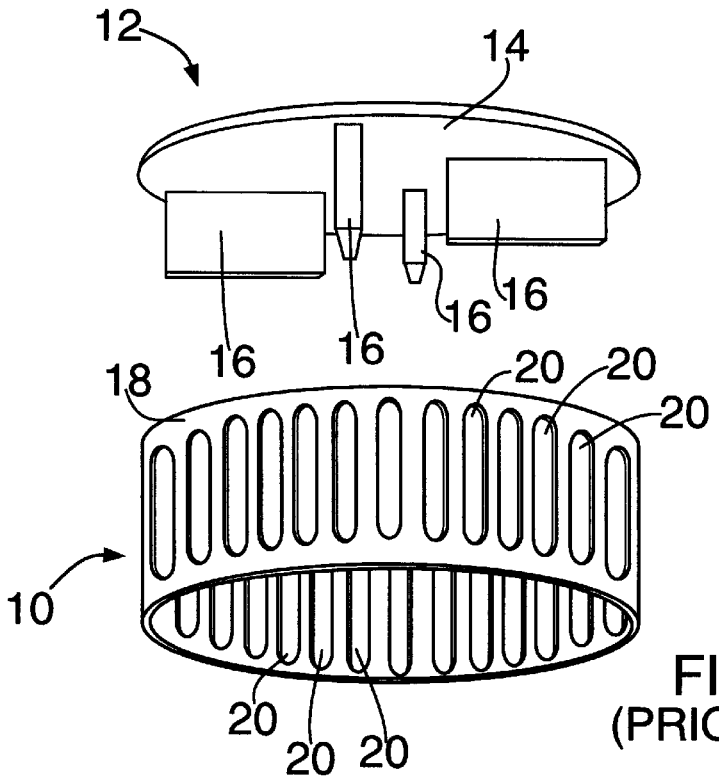
FIG. 1 (PRIOR ART)
FIGS. 1–3 are exploded schematic perspective views of prior art rotor-stator assemblies.
Figure 2:
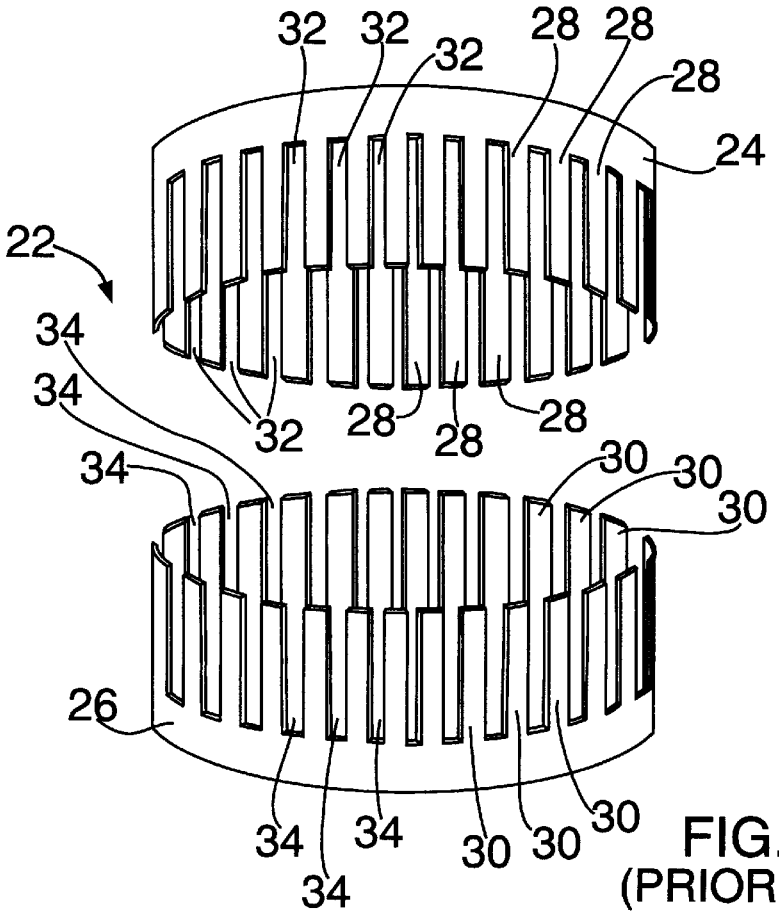
FIG. 2 (PRIOR ART)

Referring now to FIGS. 9 through 16, the first embodiment of the invention includes a rotor 200 and a stator 202. The rotor 200 has a central keyed hole 204 and a circular well 206 which defines an outer surface 208 and an inner surface 210 each of which are provided with a plurality of parallel grooves 211, 213 (seen best in FIG. 11). The stator 202 has a central fluid entry port 212, a plurality of mounting holes 214 arranged around the entry port 212, an upstanding circular flange 216 defining an outer surface 218 and an inner surface 220, each of which are provided with a plurality of parallel grooves 219, 221 (seen best in FIG. 12).

Figure 13:
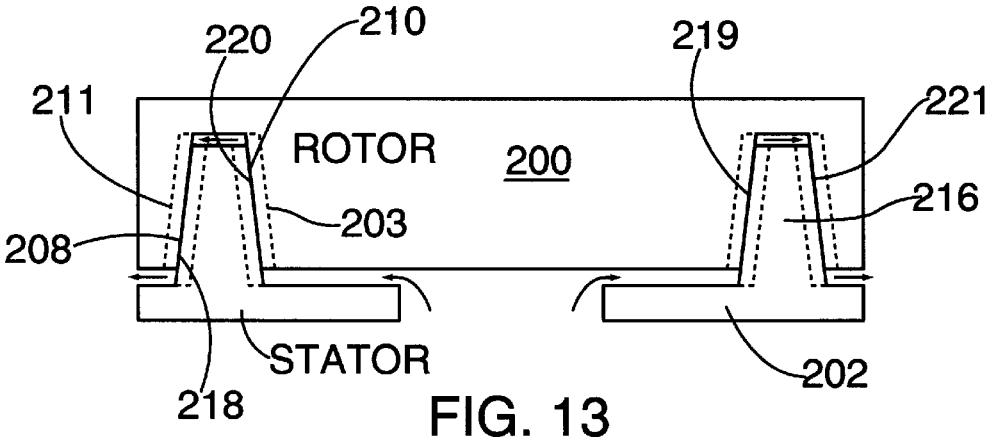
FIG. 13 is a schematic sectional view of the rotor and stator of the first embodiment illustrating the locations of two shear zones.

According to the first embodiment, the diameter of the rotor 200 is approximately 12.00" and the depth of the well 206 is approximately 1.25". As seen best in FIGS. 11 and 16, the grooves 211, 213 in the surfaces of the well are substantially circular in section. According to this embodiment, the grooves are approximately 75% circular and have a diameter of approximately 0.25" giving them a depth of approximately 0.1875". The center to center spacing of the grooves is approximately 0.310" and the ratio of groove spacing to groove depth is approximately 1.6:1. According to the invention, this ratio should be small and should not exceed 10:1. The stator is similarly dimensioned so that the upstanding flange 216 fits inside the well 206 as shown in FIG. 13. Moreover, the flange and the well are tapered approximately 7° so that the clearance between them may be adjusted. Tests performed with this embodiment were performed with a clearance of approximately 0.005".

Figure 14:
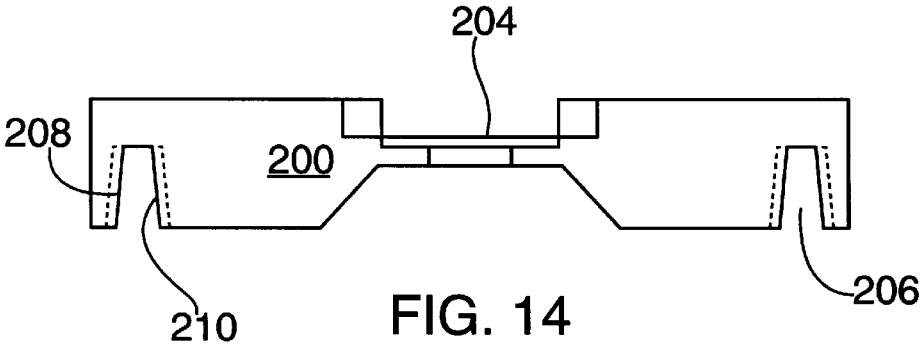
FIG. 14 is a sectional view of the rotor of the first embodiment illustrating the keyed mounting hole.
Figure 15:
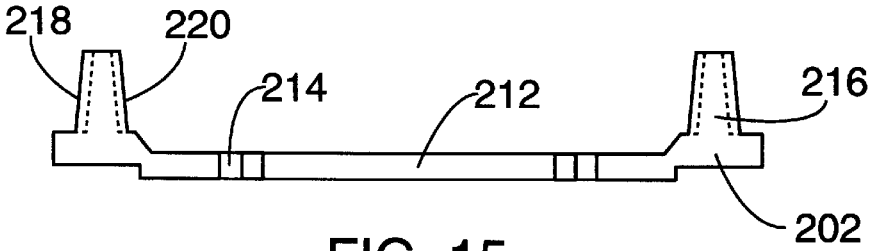
FIG. 15 is a sectional view of the stator of the first embodiment illustrating the central fluid entry port and mounting holes.

As shown best in FIGS. 13–15, this embodiment presents two shear zones, one between the surfaces 210 and 220 and the other between the surfaces 208 and 218. In operation, material flows into the inlet port 212, is drawn into the first shear zone 210–220 and forced out to the second shear zone 208–218 and is forced out of the assembly through the peripheral space between the rotor 200 and the stator 202. As the material passes up the first shear zone and down the second shear zone, high velocity streams traveling in the stator grooves interact with high velocity streams traveling in the rotor grooves. In particular, material traveling in the respective streams collide a number of times.

Figure 16:
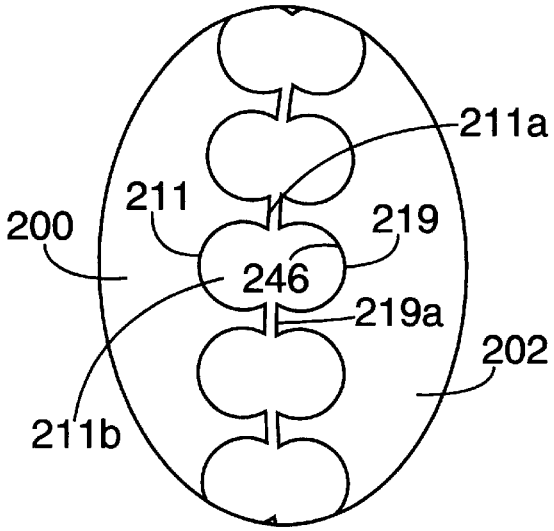
FIG. 16 is a schematic view of the grooves of the rotor and the stator of the first embodiment.
Figure 17:
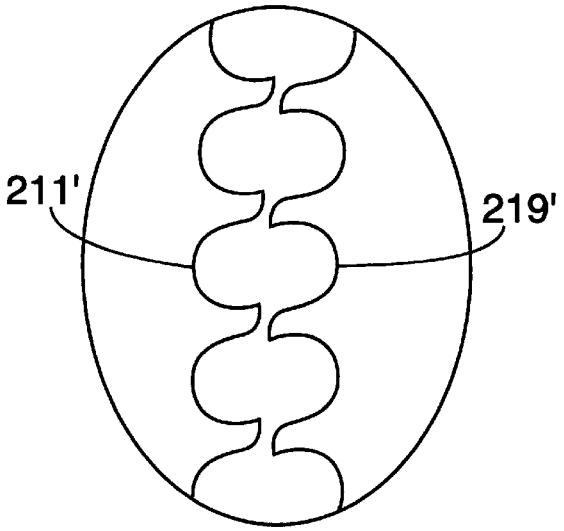
FIGS. 17–19 are views similar to FIG. 16 showing alternate geometries for the grooves.
Figure 18:
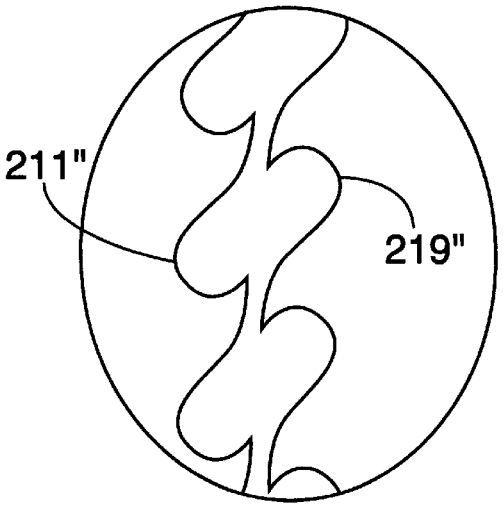
Figure 19:
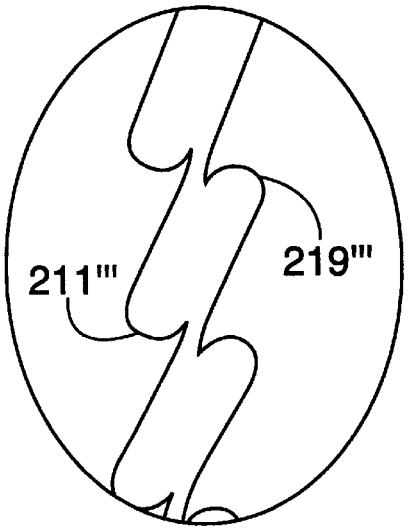

As mentioned above, the grooves define ridges and valleys. As shown in FIG. 16, the grooves 211 define ridges 211*a* and valleys 211*b* and the grooves 219 define ridges 219*a* and valleys 219*b*. The ridges 211*a* interact with the valleys 219*b* and the ridges 219*a* interact with the valleys 211*b* causing the material in the grooves to spin. It is for this reason that the grooves are preferably curved in cross section. According to the first embodiment, the grooves are 75% circular in section and it is preferred that they are no less than 50% circular. As shown in FIGS. 17–19, the grooves 211', 219', 211", 219", 211' ", 219' " may have other curved sections which are not strictly circular but which nevertheless define ridges and curved valleys.

Figure 20:
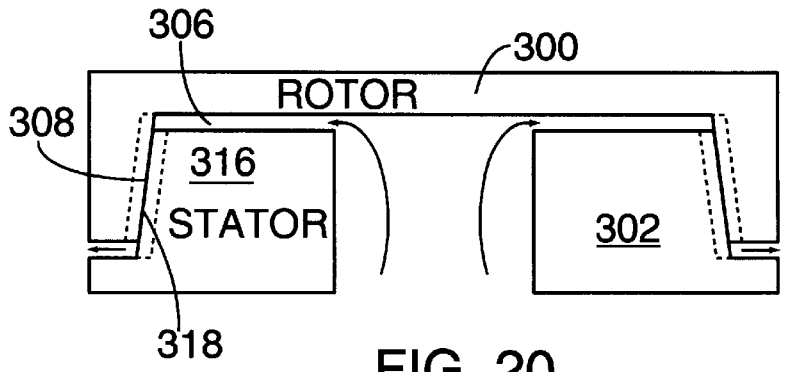
FIG. 20 is a schematic sectional view of a second embodiment of the invention having a single shear zone on the outer surface of the stator.

FIG. 20 shows a second embodiment of the invention where rotor 300 is provided with a well 306 which defines only a single inner surface 308 for grooves. The stator 302 similarly has an upstanding member 316 which defines only a single outer surface 318 for grooves. These surfaces and their grooves form a single shear zone. Material flows downward through the single shear zone.

Figure 21:
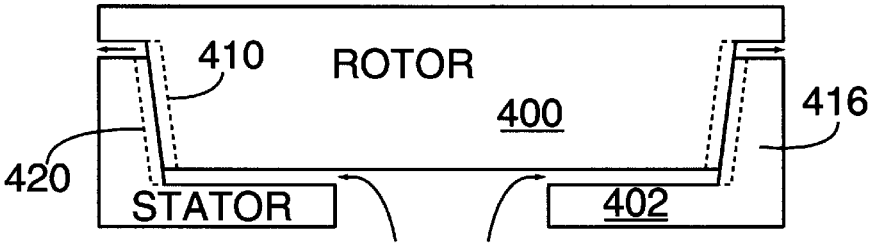
FIG. 21 is a schematic sectional view of a third embodiment of the invention having a single shear zone on the inner surface of the stator.

FIG. 21 shows a third embodiment of the invention where rotor 400 is provided with a frustrum 406 which defines only a single outer surface 410 for grooves. The stator 402 has an upstanding member 416 which defines only a single inner surface 420 for grooves. These surfaces and their grooves form a single shear zone. Material flows upward through the single shear zone.

Figure 22:
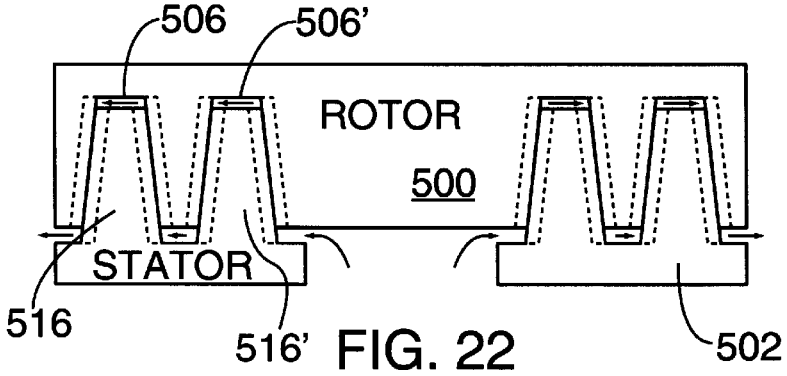
FIG. 22 is a schematic sectional view of a fourth embodiment of the invention having four shear zones.

FIG. 22 shows a fourth embodiment similar to the first embodiment except that the rotor 500 has two concentric wells 506, 506' and the stator 502 has two concentric upstanding circular flanges 516, 516'. Both of the wells and both of the flanges are provided with grooves and the resulting assembly has four shear zones.

Figure 23:
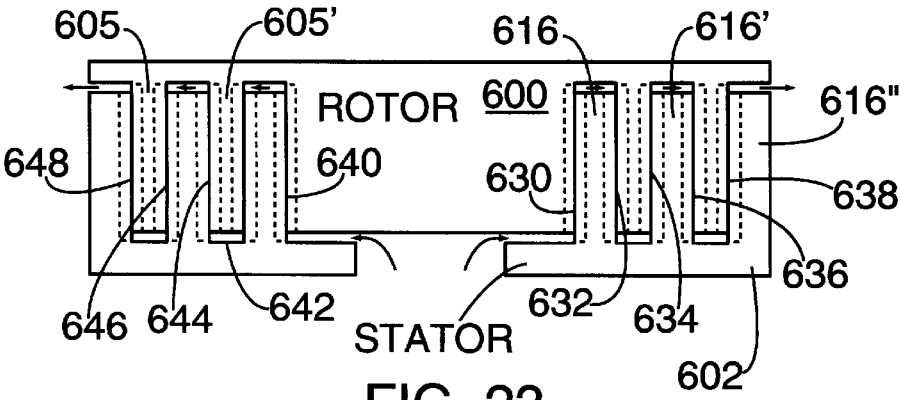
FIG. 23 is a schematic sectional view of a fifth embodiment of the invention having five shear zones with progressively smaller grooves in each zone.
Figure 24:
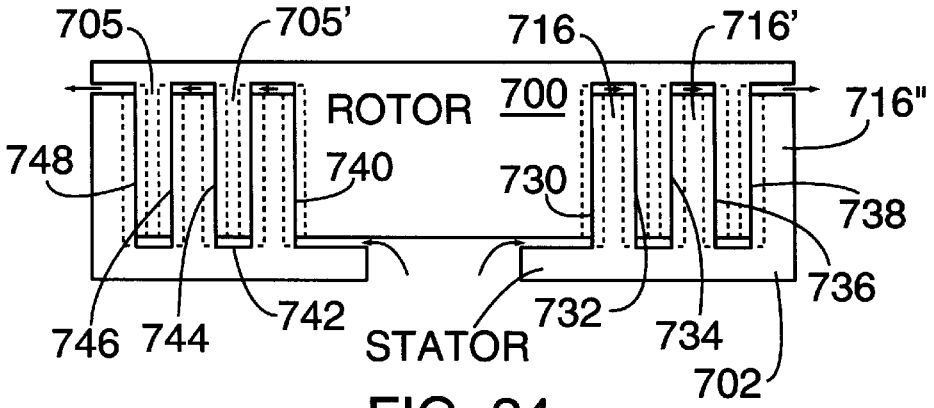
FIG. 24 is a schematic sectional view of a sixth embodiment of the invention having five shear zones, all with the same size grooves.

FIGS. 23 and 24 show fifth and sixth embodiments of the invention which are similar and where similar reference numerals refer to similar parts. According to these embodiments, the rotor 600 (700) has two concentric upstanding members 605, 605' (705, 705') defining five surfaces 630, 632, 634, 636, 638 (730, 732, 734, 736, 738). The stator 602 (702) has three concentric upstanding members 616, 616', 616" (716, 716', 716") defining surfaces so that the rotor stator has five shear zones 640, 642, 644, 646, 648 (740, 742, 744, 746, 748). None of the upstanding members are tapered. In the sixth embodiment all of the shear zones have the same sized grooves. In the fifth embodiment, the shear zone 640 has larger grooves than the grooves in the shear zone 642; the shear zone 642 has larger grooves than the grooves in the shear zone 644; the shear zone 644 has larger grooves than the grooves in the shear zone 646; and the shear zone 646 has larger grooves than the grooves in the shear zone 648.

Figure 25:
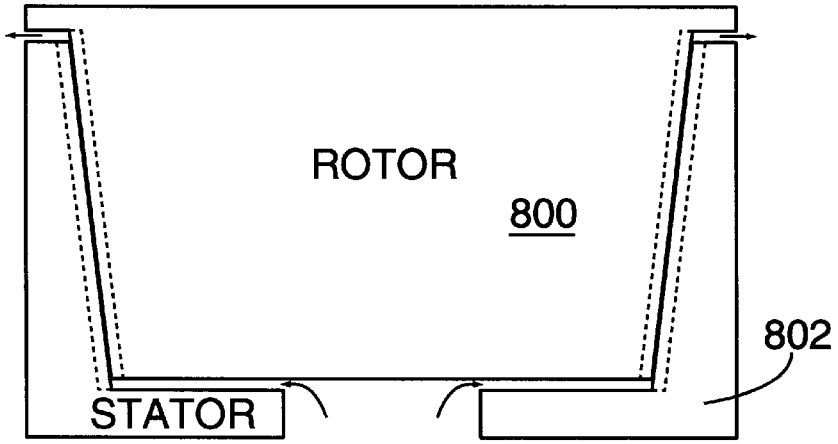
FIG. 25 is a schematic sectional view of a seventh embodiment of the invention having a single shear zone made up of grooves which are long relative to their depth.

The seventh embodiment shown in FIG. 25 is substantially the same as the third embodiment shown in FIG. 21 except that the rotor 800 and stator 802 have a much taller profile.

Figure 26:
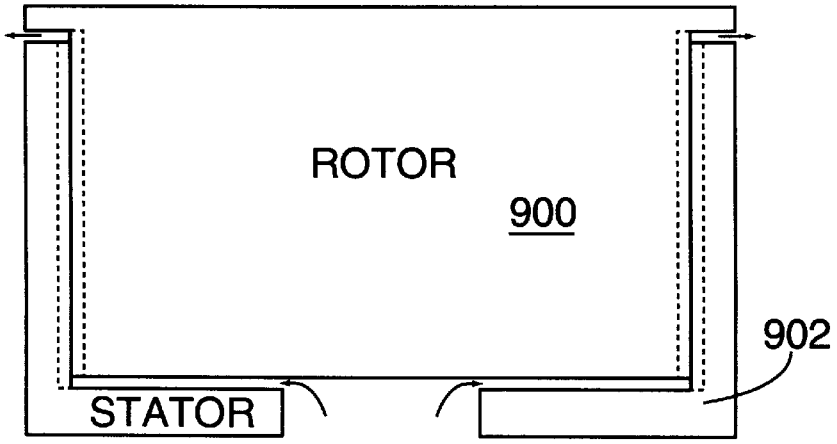
FIG. 26 is a schematic sectional view of a eighth embodiment of the invention similar to the seventh embodiment but with a non-tapered shear zone.

The eighth embodiment shown in FIG. 26 is substantially the same as the seventh embodiment shown in FIG. 25 except that the rotor 900 and stator 902 are not tapered.

Figure 27:
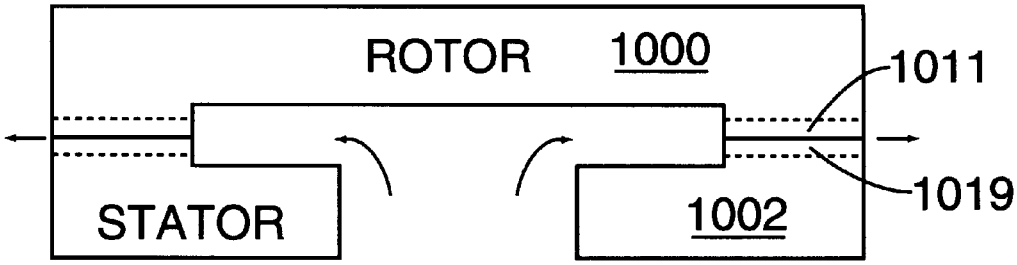
FIG. 27 is a schematic sectional view of an ninth embodiment of the invention having radial shear zones.

FIG. 27 shows a low profile rotor 1000 and stator 1002 having radial grooves 1011, 1019. The grooves are curved in cross section and define a plurality of ridges and valleys. When in operation all of the ridges on the rotor pass over all of the ridges on the stator.

Figure 28:
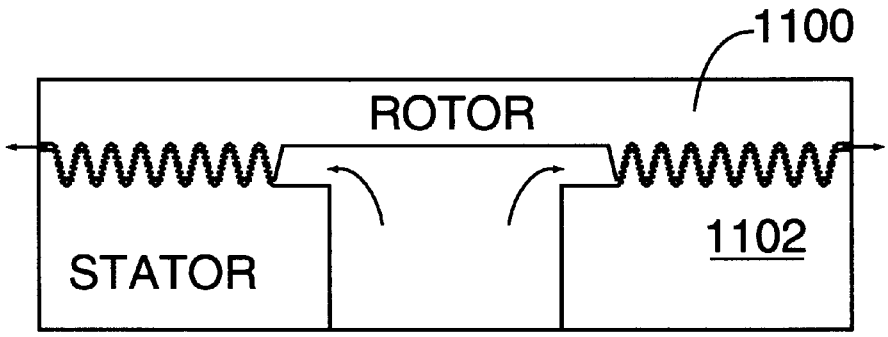
FIG. 28 is a schematic sectional view of a tenth embodiment of the invention having a low profile and fifteen shear zones.
Figure 29:
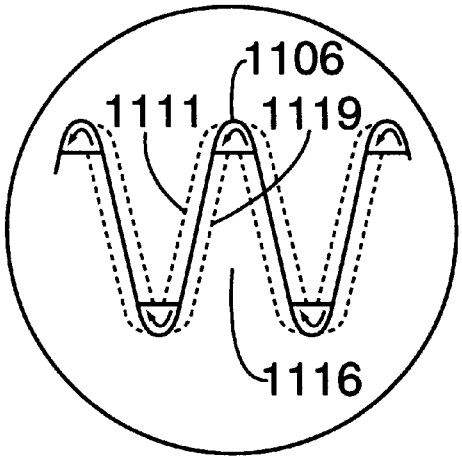
FIG. 29 is an enlarged detail of the tenth embodiment.

FIGS. 28 and 29 illustrate a low profile tenth embodiment of the invention where the rotor 1100 and the stator 1102 are similar in some respects to the rotor and stator of the '596 patent. Here, however, each of the concentric vanes 1116 on the stator is provided with a plurality of parallel grooves 1119 which extend toward the rotor. Further, each of the concentric wells 1106 on the rotor is provided with a plurality of parallel grooves 1111 which interact with the grooves on the stator as described above.

For comparative purposes, two illustrative examples of the effectiveness of the present invention is provided below in tabular form. The tests compare the prior art rotor-stator designs illustrated in FIG. 1, FIG. 3, FIGS. 4–8, to the FIGS. 9–15 embodiment of the present invention. The prior art rotor/stator dimensions are the same as set forth in U.S. Pat. No. 5,632,596, the subject matter of which is incorporated by reference herein. The FIGS. 9–15 embodiment of the mounting employed a 12 inch rotor and 12 inch stator of the type and dimensions described above.

MEDIAN DROPLET SIZE IN MICRONS 5% OIL IN WATER EMULSION

Figure 3:
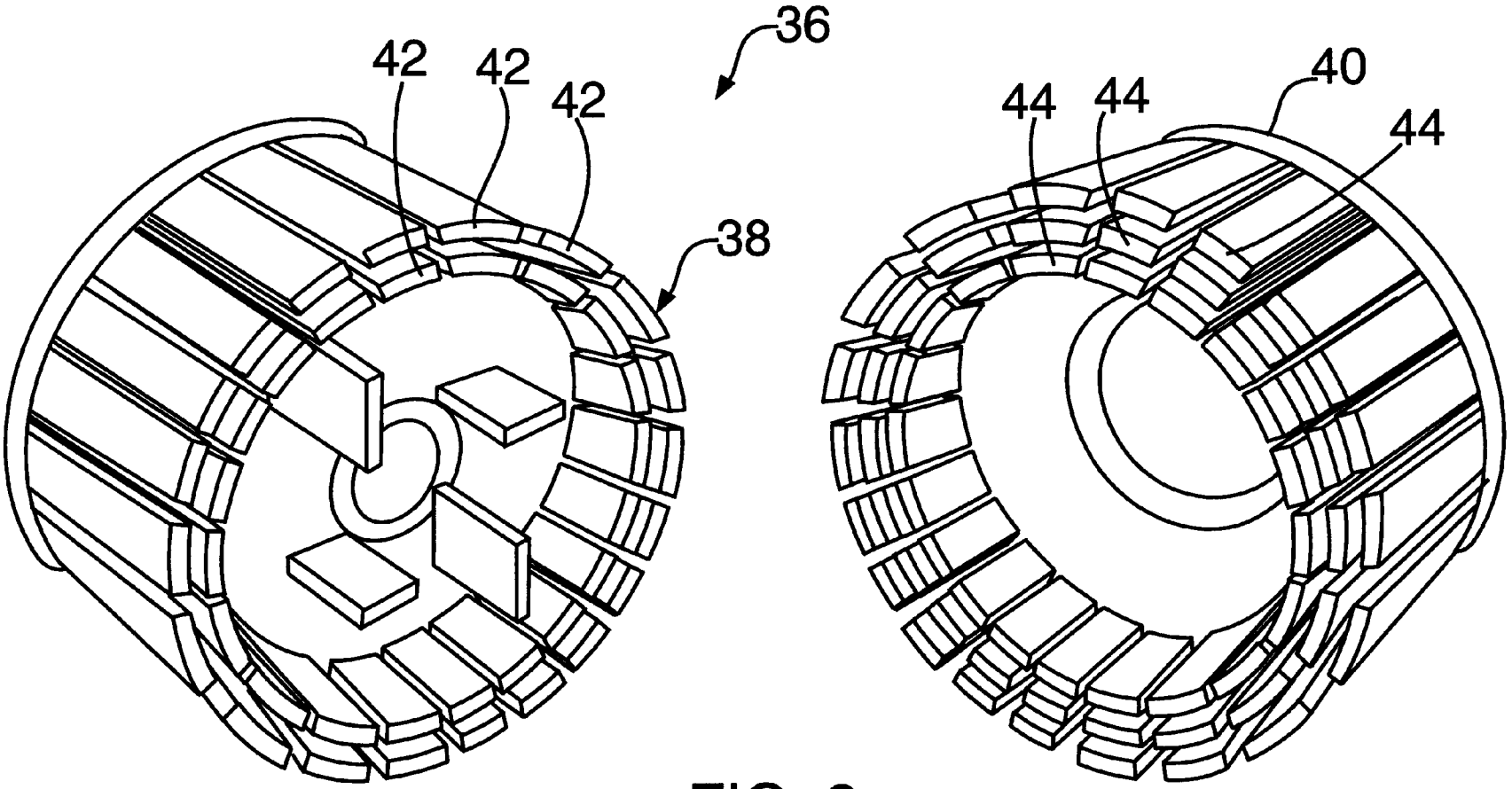
FIG. 3 (PRIOR ART)
Figure 4:
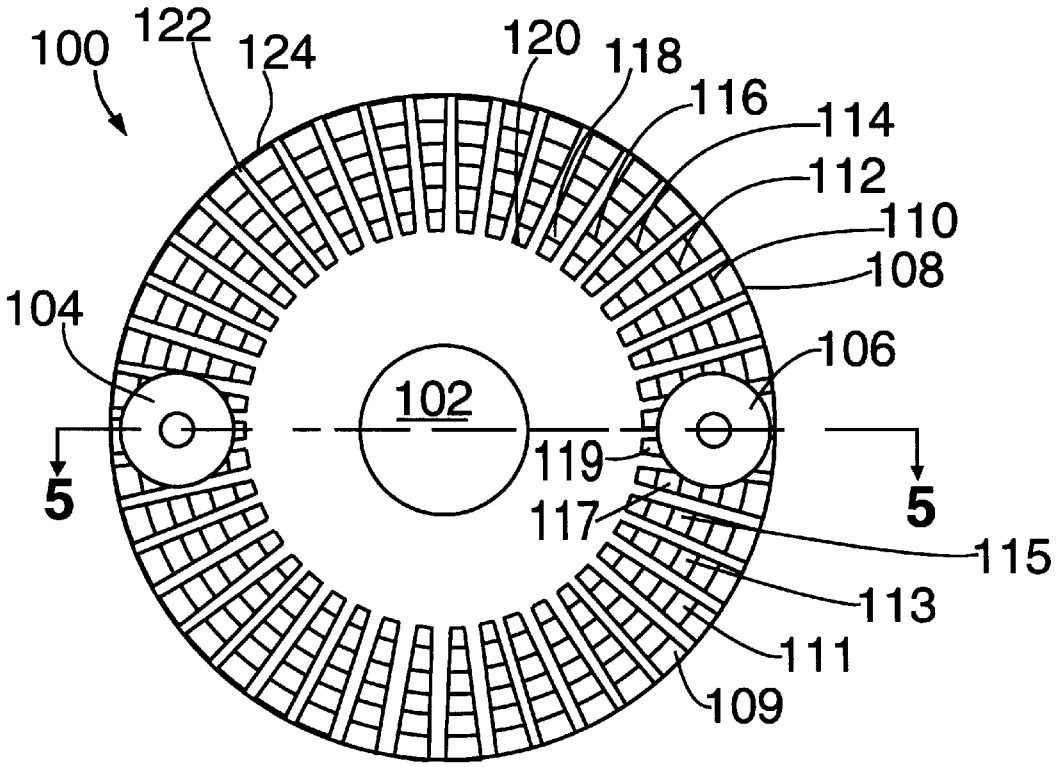
FIG. 4 (PRIOR ART)
FIGS. 4–8 are plan and sectional views of a rotor and stator according to co-owned U.S. Pat. No. 5,632,596.
Figure 5:
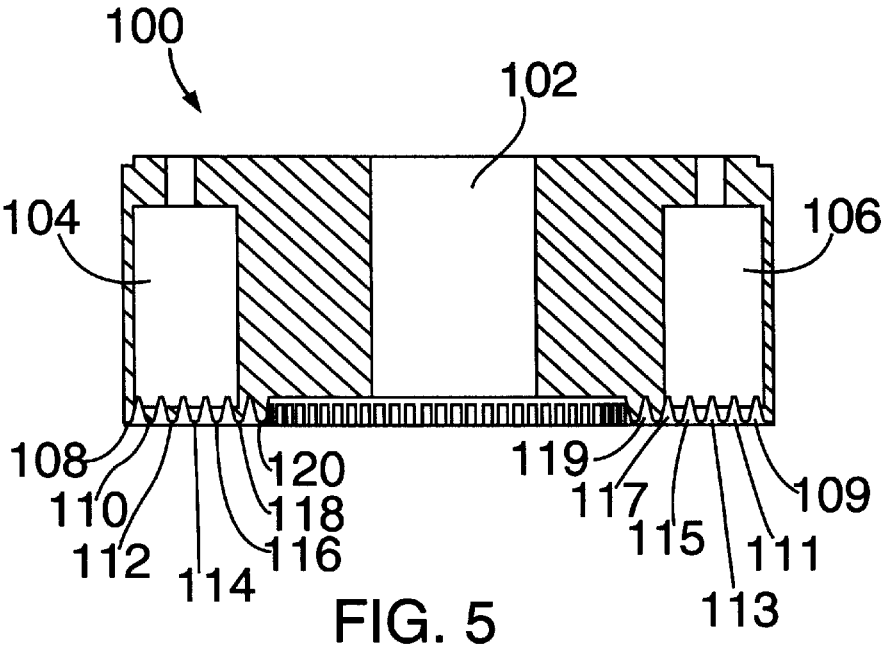
FIG. 5 (PRIOR ART)
Figure 6:
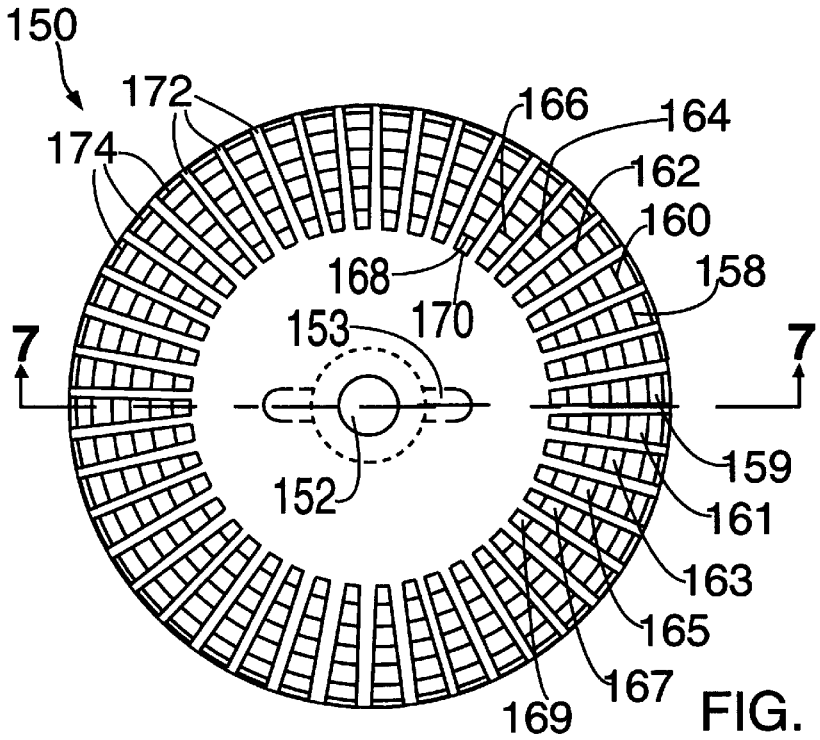
FIG. 6 (PRIOR ART)
Figure 7:
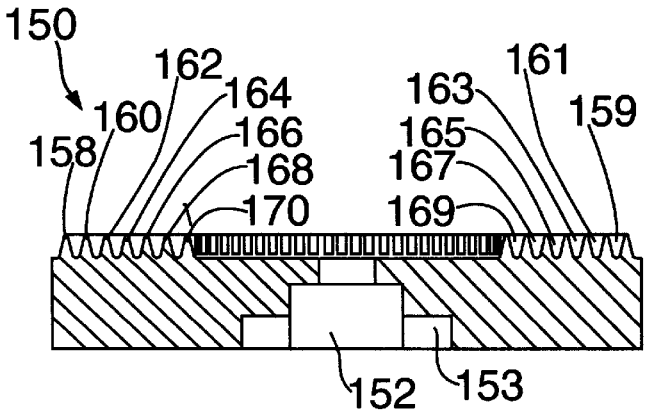
FIG. 7 (PRIOR ART)
Figure 8:
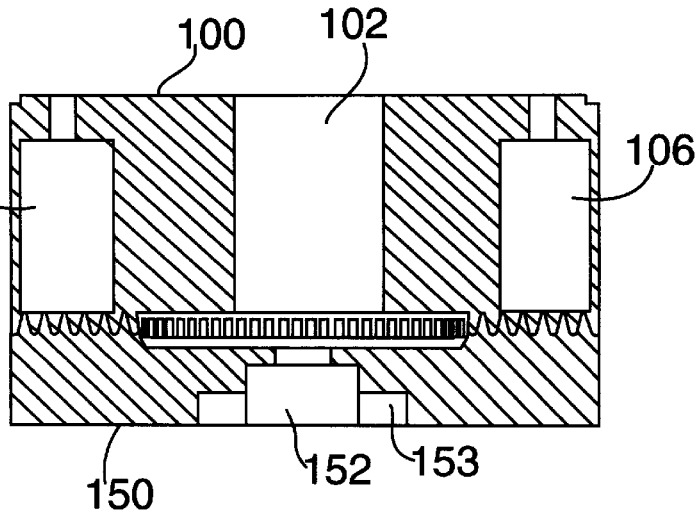
FIG. 8 (PRIOR ART)
Figure 9:
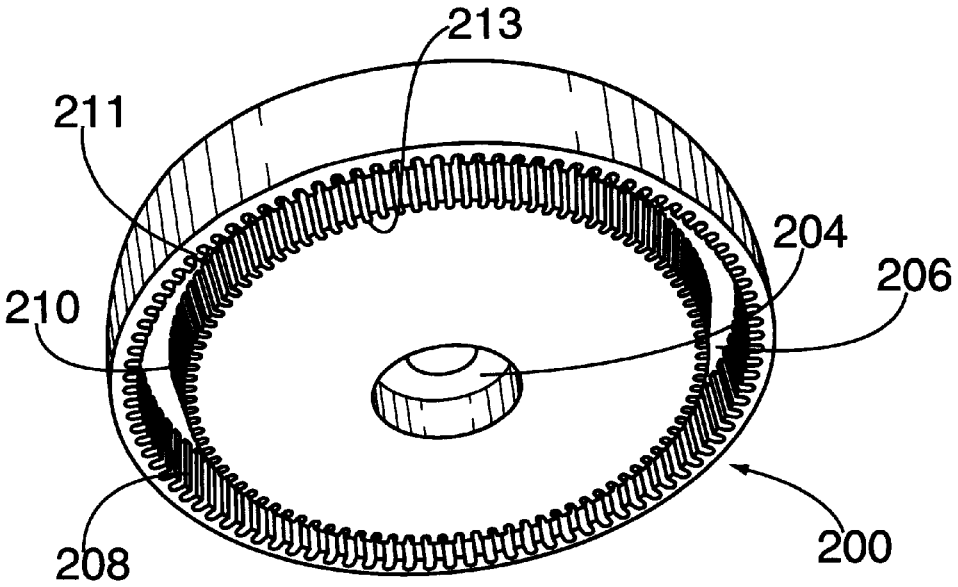
FIG. 9 is a perspective view of a rotor according to a first embodiment of the invention.
Figure 10:
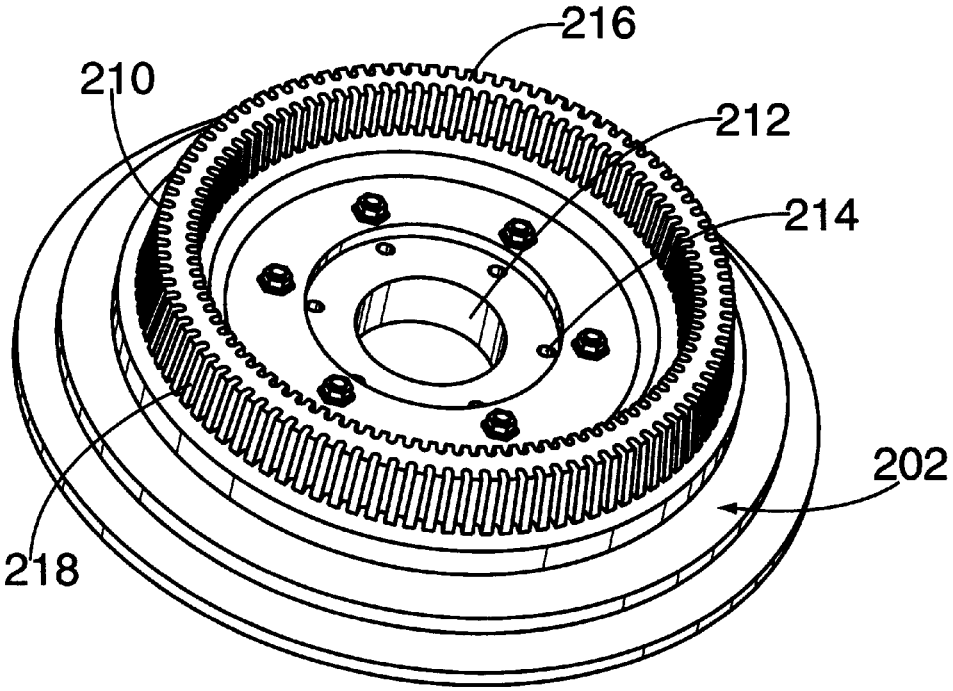
FIG. 10 is a perspective view of a stator according to the first embodiment of the invention.
Figure 11:
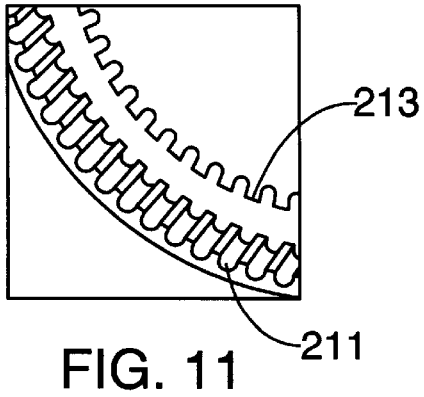
FIG. 11 is an enlarged perspective view of a portion of the rotor of FIG. 9.
Figure 12:
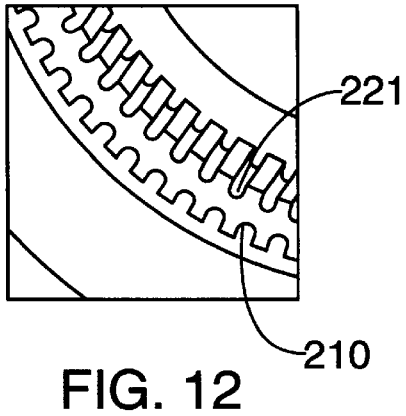
FIG. 12 is an enlarged perspective view of a portion of the stator of FIG. 10.

| # OF PASSES | FIG. 1 | FIG. 3 | FIGS. 4–8 | FIGS. 9–15 |
|---|---|---|---|---|
| Start | 41.21 | 41.21 | 41.21 | 41.21 |
| 1 | 10.49 | 3.95 | 2.79 | 1.34 |
| 2 | 6.82 | 3.38 | 2.48 | 0.96 |
| 3 | 6.15 | 2.98 | 2.15 | 0.85 |
| 4 | 5.58 | 2.52 | 1.91 | 0.79 |
| 5 | 5.20 | 2.35 | 1.66 | 0.75 |

The above results were obtained by recirculating through each device a 5% oil in water emulsion having an initial median droplet size of 41.21 microns. The number of passes were determined by taking the flow rate for each device and the batch size into account to determine the correct sampling time intervals. As can be seen, the above table represents the relative drop or decrease in median droplet size in microns of the 5% oil in water emulsion after five passes through each device. As can be seen, after five passes, the present invention of FIGS. 9–15 produced a median droplet size of 0.75 microns which was more than 50% less than the closest prior art design, thus representing a dramatic improvement in rotor-stator performance over the prior art designs.

NUMBER OF PASSES REQUIRED TO REACH TARGET MEDIAN DROPLET SIZE OF 0.13 MICRONS FROM STARTING MEDIAN DROPLET SIZE OF 10.87 MICRONS USING A MICRO-EMULSION CONSISTING OF 15% OIL, 80% WATER AND 5% SURFACTANT

| | FIG. 1 | FIG. 3 | FIGS. 4–8 | FIGS. 9–15 |
|---|---|---|---|---|
| # of Passes | 1148 | 87 | 46 | 32 |

In the second test as shown above in tabular form, the prior art rotor-stator designs illustrated in FIGS. 1, FIGS. 3, and FIGS. 4–8 were again compared to the present invention as shown in FIGS. 9–15. A micro-emulsion consisting of 15% oil, 80% water, and 5% surfactant having a starting median droplet size of 10.87 microns was recirculated through each device until a target droplet size of 0.13 microns was reached. The total number of passes required for each device to reach this target median droplet size was recorded and, once again, the number of passes to reach the target median droplet size was determined by taking the flow rate for each device and the batch size into account. As can be seen, the present invention had the lowest number of passes, namely 32, as compared to Applicant's prior invention of FIGS. 4–8 which took 46 passes to reach the target size. Thus, there was an approximately 30% reduction in the number of passes (and time), further representing a dramatic improvement in rotor-stator performance over the prior art designs.

Finally, it should be noted that, although the rotor and stator grooves are shown in the various embodiments as being parallel, they may advantageously be tilted or angled up to about 10 degrees with respect to the vertical, in the same or opposite direction.

There have been described and illustrated herein several embodiments of a high shear rotor and stator. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. A rotor-stator assembly, comprising:

a) a substantially cylindrical rotor having at least one rotor surface which includes a first plurality of rotor grooves, each of said rotor grooves being substantially continuous, and b) a substantially cylindrical stator having at least one stator surface which includes a first plurality of stator grooves, each of said stator grooves being substantially continuous, wherein said rotor and said stator are mounted such that said first plurality of rotor grooves are substantially parallel to said first plurality of stator grooves and such that when said rotor is rotated relative to said stator each of said first plurality of rotor grooves passes each of said first plurality of stator groves and wherein each of said grooves in said first plurality of rotor grooves and each of said grooves in said first plurality of stator grooves has a cross section which is at least approximately 75% circular.

2. A rotor-stator assembly according to claim 1, wherein:

each of said grooves in said first plurality of rotor grooves has a first depth, each of said grooves in said first plurality of rotor grooves is spaced apart from each other by a first spacing, and the ratio of said first spacing to said first depth is no more than 10:1.

3. A rotor-stator assembly according to claim 2, wherein:

said first plurality of rotor grooves corresponds in size and number to said first plurality of stator grooves.

4. A rotor-stator assembly according to claim 3, wherein:

the ratio of said first spacing to said first depth is less than 2:1.

5. A rotor-stator assembly according to claim 3, wherein:

the ratio of said first spacing to said first depth is approximately 1.6:1.

6. A rotor-stator assembly according to claim 1, wherein:

each of said grooves in said first plurality of rotor grooves and each of said grooves in said first plurality of stator grooves has a cross section which is approximately 75% circular.

7. A rotor-stator assembly according to claim 1, wherein:

each of said grooves in said first plurality of rotor grooves and each of said grooves in said first plurality of stator grooves has a cross section which is more than 75% circular.

8. A rotor-stator assembly according to claim 1, wherein:

said at least one rotor surface and said at least one stator surface are tapered.

9. A rotor-stator assembly according to claim 1, wherein:

said at least one rotor surface and said at least one stator surface are tapered approximately 7°.

10. A rotor-stator assembly according to claim 1, wherein:

said at least one rotor surface includes first and second rotor surfaces including respective first and second pluralities of rotor grooves, and said at least one stator surface includes first and second stator surfaces including respective first and second pluralities of stator grooves.

11. A rotor-stator assembly according to claim 1, wherein:

said at least one rotor surface is frustroconical.

12. A rotor-stator assembly according to claim 1, wherein:

said at least one stator surface is frustroconical.

13. A rotor-stator assembly according to claim 1, wherein:

said at least one rotor surface includes a plurality of rotor surfaces including a corresponding pluralities of rotor grooves, and said at least one stator surface includes a plurality of stator surfaces including a corresponding pluralities of stator grooves.

14. A rotor-stator assembly according to claim 1, wherein:

said first plurality of rotor grooves lie in a first plane, and said first plurality of stator grooves lie in a second plane which is substantially parallel to said first plane.

15. A rotor-stator assembly according to claim 14, wherein:

said first plurality of rotor grooves are arranged radially in said first plane, and said first plurality of stator grooves are arranged radially in said second plane.

16. A rotor-stator assembly, comprising:

a) a substantially cylindrical rotor having at least one rotor surface which includes a first plurality of rotor grooves, each of said rotor grooves being substantially continuous, and b) a substantially cylindrical stator having at least one stator surface which includes a first plurality of stator grooves, each of said stator grooves being substantially continuous, wherein said rotor and said stator are mounted such that said first plurality of rotor grooves are substantially parallel to said first plurality of stator grooves and such that when said rotor is rotated relative to said stator each of said first plurality of rotor grooves passes each of said first plurality of stator grooves and wherein said at least one rotor surface includes first and second rotor surfaces including respective first and second pluralities of rotor grooves, and said at least one stator surface includes first and second stator surfaces including respective first and second pluralities of stator grooves.

17. A rotor-stator assembly according to claim 16, wherein:

each of said grooves in said first plurality of rotor grooves has a first depth, each of said grooves in said first plurality of rotor grooves is spaced apart from each other by a first spacing, and the ratio of said first spacing to said first depth is no more than 10:1.

18. A rotor-stator assembly according to claim 17, wherein:

said first plurality of rotor grooves corresponds in size and number to said first plurality of stator grooves.

19. A rotor-stator assembly according to claim 18, wherein:

the ratio of said first spacing to said first depth is less than 2:1.

20. A rotor-stator assembly according to claim 18, wherein:

the ratio of said first spacing to said first depth is approximately 1.6:1.

21. A rotor-stator assembly according to claim 16, wherein:

each of said grooves in said first plurality of rotor grooves and each of said grooves in said first plurality of stator grooves has a cross section which is more than 50% circular.

22. A rotor-stator assembly according to claim 16, wherein:

each of said grooves in said first plurality of rotor grooves and each of said grooves in said first plurality of stator grooves has a cross section which is approximately 75% circular.

23. A rotor-stator assembly according to claim 16, wherein:

each of said grooves in said first plurality of rotor grooves and each of said grooves in said first plurality of stator grooves has a cross section which is more than 75% circular.

24. A rotor-stator assembly according to claim 16, wherein:

said at least one rotor surface and said at least one stator surface are tapered.

25. A rotor-stator assembly according to claim 16, wherein:

said at least one rotor surface and said at least one stator surface are tapered approximately 70.

26. A rotor-stator assembly according to claim 16, wherein:

said at least one rotor surface is frustroconical.

27. A rotor-stator assembly according to claim 16, wherein:

said at least one stator surface is frustroconical.

28. A rotor-stator assembly according to claim 16, wherein:

said at least one rotor surface includes a plurality of rotor surfaces including a corresponding pluralities of rotor grooves, and said at least one stator surface includes a plurality of stator surfaces including a corresponding pluralities of stator grooves.

29. A rotor-stator assembly according to claim 16, wherein:

said first plurality of rotor grooves lie in a first plane, and said first plurality of stator grooves lie in a second plane which is substantially parallel to said first plane.

30. A rotor-stator assembly according to claim 29, wherein:

said first plurality of rotor grooves are arranged radially in said first plane, and said first plurality of stator grooves are arranged radially in said second plane.

31. A rotor-stator assembly, comprising:

a) a substantially cylindrical rotor having at least one rotor surface which includes a first plurality of rotor grooves, each of said rotor grooves being substantially continuous, and b) a substantially cylindrical stator having at least one stator surface which includes a first plurality of stator grooves, each of said stator grooves being substantially continuous, wherein said rotor and said stator are mounted such that said first plurality of rotor grooves are substantially parallel to said first plurality of stator grooves and such that when said rotor is rotated relative to said stator each of said first plurality of rotor grooves passes each of said first plurality of stator grooves and wherein said at least one rotor surface includes a plurality of rotor surfaces including a corresponding pluralities of rotor grooves, and said at least one stator surface includes a plurality of stator surfaces including a corresponding pluralities of stator grooves.

32. A rotor-stator assembly according to claim 31, wherein:

each of said grooves in said first plurality of rotor grooves has a first depth, each of said grooves in said first plurality of rotor grooves is spaced apart from each other by a first spacing, and the ratio of said first spacing to said first depth is no more than 10:1.

33. A rotor-stator assembly according to claim 32, wherein:

said first plurality of rotor grooves corresponds in size and number to said first plurality of stator grooves.

34. A rotor-stator assembly according to claim 33, wherein:

the ratio of said first spacing to said first depth is less than 2:1.

35. A rotor-stator assembly according to claim 32, wherein:

the ratio of said first spacing to said first depth is approximately 1.6:1.

36. A rotor-stator assembly according to claim 31, wherein:

each of said grooves in said first plurality of rotor grooves and each of said grooves in said first plurality of stator grooves has a cross section which is more than 50% circular.

37. A rotor-stator assembly according to claim 31, wherein:

each of said grooves in said first plurality of rotor grooves and each of said grooves in said first plurality of stator grooves has a cross section which is approximately 75% circular.

38. A rotor-stator assembly according to claim 31, wherein:

each of said grooves in said first plurality of rotor grooves and each of said grooves in said first plurality of stator grooves has a cross section which is more than 75% circular.

39. A rotor-stator assembly according to claim 31, wherein:

said at least one rotor surface and said at least one stator surface are tapered.

40. A rotor-stator assembly according to claim 31, wherein:

said at least one rotor surface and said at least one stator surface are tapered approximately 7°.

41. A rotor-stator assembly according to claim 31, wherein:

said at least one rotor surface includes first and second rotor surfaces including respective first and second pluralities of rotor grooves, and said at least one stator surface includes first and second stator surfaces including respective first and second pluralities of stator grooves.

42. A rotor-stator assembly according to claim 31, wherein:

said at least one rotor surface is frustroconical.

43. A rotor-stator assembly according to claim 31, wherein:

said at least one stator surface is frustroconical.

44. A rotor-stator assembly according to claim 31, wherein:

said first plurality of rotor grooves lie in a first plane, and said first plurality of stator grooves lie in a second plane which is substantially parallel to said first plane.

45. A rotor-stator assembly according to claim 44, wherein:

said first plurality of rotor grooves are arranged radially in said first plane, and said first plurality of stator grooves are arranged radially in said second plane.

46. A rotor-stator assembly, comprising:

a) a substantially cylindrical rotor having at least one rotor surface which includes a first plurality of rotor grooves, each of said rotor grooves being substantially continuous, and b) a substantially cylindrical stator having at least one stator surface which includes a first plurality of stator grooves, each of said stator grooves being substantially continuous, wherein said rotor and said stator are mounted such that said first plurality of rotor grooves are substantially parallel to said first plurality of stator grooves and such that when said rotor is rotated relative to said stator each of said first plurality of rotor grooves passes each of said first plurality of stator grooves, wherein each of said grooves in said first plurality of rotor grooves has a first depth, each of said grooves in said first plurality of rotor grooves is spaced apart from each other by a first spacing, and the ratio of said first spacing to said first depth is no more than 10:1, said first plurality of rotor grooves corresponds in size and number to said first plurality of stator grooves, and the ratio of said first spacing to said first depth is approximately 1.6:1.

47. A rotor-stator assembly, comprising:

a) a substantially cylindrical rotor having at least one rotor surface which includes a first plurality of rotor grooves, each of said rotor grooves being substantially continuous, and b) a substantially cylindrical stator having at least one stator surface which includes a first plurality of stator grooves, each of said stator grooves being substantially continuous, wherein said rotor and said stator are mounted such that said first plurality of rotor grooves are substantially parallel to said first plurality of stator grooves and such that when said rotor is rotated relative to said stator each of said first plurality of rotor grooves passes each of said first plurality of stator grooves, and wherein said at least one rotor surface and said at least one stator surface are tapered approximately 7°.

* * * * *